US010179335B2

(12) United States Patent
Malmqvist et al.

(10) Patent No.: US 10,179,335 B2
(45) Date of Patent: Jan. 15, 2019

(54) CRUSHER WEAR RESISTANT LINER

(71) Applicant: SANDVIK INTELLECTUAL PROPERTY AB, Sandviken (SE)

(72) Inventors: Patric Malmqvist, Svedala (SE); Mikael M. Larsson, Eslov (SE); Bengt-Arne Eriksson, Svedala (SE); Axel Bergman, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 112 days.

(21) Appl. No.: 14/441,510

(22) PCT Filed: Oct. 8, 2013

(86) PCT No.: PCT/EP2013/070868
§ 371 (c)(1),
(2) Date: May 7, 2015

(87) PCT Pub. No.: WO2014/072136
PCT Pub. Date: May 15, 2014

(65) Prior Publication Data

US 2015/0283549 A1 Oct. 8, 2015

(30) Foreign Application Priority Data

Nov. 8, 2012 (EP) ..... 12191768

(51) Int. Cl.
*B02C 2/00* (2006.01)
*B02C 17/22* (2006.01)

(52) U.S. Cl.
CPC ..... *B02C 2/005* (2013.01); *B02C 17/22* (2013.01); *B02C 2210/02* (2013.01)

(58) Field of Classification Search
CPC ..... B02C 2/005; B02C 17/22
USPC ..... 241/182, 183
See application file for complete search history.

(56) References Cited

U.S. PATENT DOCUMENTS 971,196 A 9/1910 Hibbard
1,174,160 A * 3/1916 Jenson ..... B02C 17/22 241/183
1,538,620 A 5/1925 Canda
2,216,784 A * 10/1940 Payne ..... B02C 17/22 241/182
2,967,671 A * 1/1961 Fernando ..... B02C 17/22 241/176
3,318,537 A 5/1967 Wilhelm et al.
(Continued)

FOREIGN PATENT DOCUMENTS

CN 86100920 A 10/1986
CN 1305877 A 8/2001
(Continued)

*Primary Examiner* — Faye Francis
(74) *Attorney, Agent, or Firm* — Corinne R. Gorski

(57) ABSTRACT

A crusher wear resistant liner for positioning at a crusher bottom shell includes a plurality of modular wear resistant plates mountable at an inside surface of the bottom shell and positioned side-by-side to surround and protect the bottom shell interior. To prevent independent dislodgement of each plate and liner, respective inter-engaging formations are provided at each plate to contact at least one adjacent plate of the assembly to arrest any unintentional downward movement in the event that the primary fixings become ineffective.

14 Claims, 6 Drawing Sheets

(56) References Cited

U.S. PATENT DOCUMENTS

| | | | | | |
|---|---|---|---|---|---|
| 3,378,209 | A * | 4/1968 | Crocheron | B02C 17/225 | 241/102 |
| 3,540,603 | A | 11/1970 | Neumeier | | |
| 3,804,346 | A * | 4/1974 | Norman | B02C 17/225 | 241/182 |
| 3,949,943 | A | 4/1976 | Schuler et al. | | |
| 4,065,064 | A | 12/1977 | Anthony | | |
| 4,141,511 | A * | 2/1979 | Anderson | B02C 17/225 | 241/183 |
| 5,323,976 | A | 6/1994 | Johnson et al. | | |
| 5,638,890 | A * | 6/1997 | Didion | B22D 31/007 | 164/131 |
| 5,950,944 | A * | 9/1999 | Larsen | B02C 17/22 | 241/183 |
| 6,206,310 | B1 * | 3/2001 | Schneider | B02C 17/22 | 241/183 |
| 6,595,267 | B2 * | 7/2003 | Didion | B22D 31/007 | 164/131 |
| 7,584,918 | B1 | 9/2009 | Briggs, Jr. et al. | | |
| 8,136,649 | B2 * | 3/2012 | Burstrom | B65G 11/166 | 193/2 R |
| 2002/0023729 | A1 * | 2/2002 | Didion | B22D 31/007 | 164/269 |

FOREIGN PATENT DOCUMENTS

| | | | |
|---|---|---|---|
| CN | 101687200 | A | 3/2010 |
| CN | 102481580 | A | 5/2012 |
| CN | 102665919 | A | 9/2012 |
| DE | 1607491 | A1 | 9/1969 |
| DE | 2262726 | A1 | 7/1974 |
| WO | 99/03587 | A1 | 1/1999 |

* cited by examiner

CRUSHER WEAR RESISTANT LINER

RELATED APPLICATION DATA

This application is a § 371 National Stage Application of PCT International Application No. PCT/EP2013/070868 filed Oct. 8, 2013 claiming priority of EP Application No. 1219178.6, filed Nov. 8, 2012.

FIELD OF INVENTION

The present invention relates to a crusher wear resistant liner for positioning at a crusher bottom shell, and in particular, although not exclusively, to a modular liner in which a plurality of individual wear resistant plates are prevented from dislodgement from the bottom shell by respective interengaging formations.

BACKGROUND ART

Gyratory crushers are used for crushing ore, mineral and rock material to smaller sizes. Typically, the crusher comprises a crushing head mounted upon an elongate main shaft. A first crushing shell is mounted on the crushing head and a second crushing shell is mounted on a frame such that the first and second crushing shells define together a crushing gap through which material to be crushed is passed. A driving device positioned at a lower region of the main shaft is configured to rotate an eccentric assembly about the shaft to cause the crushing head to perform a gyratory pendulum movement and crush the material introduced in the crushing gap. Typically, the frame of the crusher that, in part, defines the crushing zone comprises a top shell and a bottom shell. The top shell is generally protected by the first crushing shell. It is then generally conventional to include a wear protection liner at the bottom shell as this region of the crusher is also exposed to the flow of processed materials.

U.S. Pat. No. 4,065,064 discloses a lining plate for use in protecting the bottom shell of a gyratory crusher. The plates comprises a generally trapezoid shape and has mounting bore holes through which fastening bolts attach the plates directly to the inner surface of the bottom shell.

However, existing protection liners are problematic as the individual plates may be inadvertently dislodged if the securing bolts fail following periods of use. The plates then fall into the crushing chamber and cause significant damage which, in turn, requires the crusher to be shut-down for maintenance and repair causing significant disruption.

What is required is a wear protection liner that addresses the above problems.

SUMMARY OF THE INVENTION

It is an object of the present invention to provide a modular wear protection liner for a crusher bottom shell that is prevented from falling into the crushing chamber in the event that the primary fixings fail and/or themselves become dislodged so as to no longer function to retain the liner parts at the bottom shell.

The objective is achieved by providing a redundancy mounting or secondary retainer fixing that functions to retain the individual liner modules or plates at the bottom shell in the event that primary fixings have become ineffective.

According to a specific implementation the redundancy fixings comprises at least one interengaging formation provided at each component part of the modular wear resistant liner that is configured to contact at least one adjacent liner, mounted at the bottom shell, and to prevent the liner falling downward from the inside surface of the bottom shell.

According to a specific implementation, the redundancy fixings comprises at least one flange extending laterally from a side edge of each plate to contact against an adjacent or neighbouring plate to provide an interlocking unitary liner structure. The fixings may be formed integrally or non-integrally with each modular plate.

According to a first aspect of the present there is provided a crusher wear resistant liner for positioning at a crusher bottom shell, the liner comprising: a plurality of wear resistant plates mountable at an inside of the bottom shell adjacent to each other to at least partially protect the inside of the bottom shell; each plate comprising side edges and a top and a bottom edge to define a perimeter of the plate; characterised in that each plate comprises: at least one interengaging formation configured to engage with an adjacent plate and/or and interengaging formation of an adjacent plate, the interengaging formations configured to at least partially interlock adjacent plates and inhibit or prevent independent dislodgement of each plate from the liner.

Preferably, at least one interengaging formation comprises a first type having a flange that projects laterally from at least one side edge of the plate. Preferably, at least one interengaging formation comprises a second type having a recessed portion to at least partially receive the flange of an adjacent plate, the recessed portion positioned adjacent at least one side edge of the plate. Preferably, the second type of interengaging formation further comprises a flange that projects laterally from at least one side edge of the plate.

Preferably, each interengaging formation is non-integrally formed at each plate and comprises a panel-like body mounted to a rear face of each plate.

Preferably, the liner comprises a first type of plate having a first shape configuration and a second type of plate having a second shape configuration, the first type positionable adjacent the second type of plate in alternating sequence around the inside of the bottom shell. Optionally, each plate comprises a generally trapezoidal shape configuration.

Preferably, the first type of plate comprises the first type of interengaging formation at each side edge and the second type of plate comprises the second type of interengaging formation at each side edge.

Preferably, the flange extends from a rear face of the plate a distance beyond the side edge to overlay onto a rear face of an adjacent plate so as to provide a laterally extending bridge connecting adjacent plates.

Preferably, each of the plates comprise bore holes for mounting via fasteners to the bottom shell.

Optionally, each interengaging formation comprises bore holes positionally spaced apart to align with the bore holes of the plate to receive the fasteners that mount each plate to the bottom shell.

Optionally, each plate comprises four bore holes and each interengaging formation comprises two bore holes, each plate comprising two interengaging formations positioned adjacent respective side edges.

Optionally, the first type of plate comprises a length in a direction between the top and the bottom edge that is greater than a corresponding length of the second type of plate; and the second type of plate comprises a width in a direction between the side edges that is greater than a width of the first type of plate.

Preferably each plate comprises a lifting eyelet. Optionally, the lifting eyelet is attached to the plate at a rear face of the plate such that a portion of the eyelet is positionable intermediate the plate and an inside surface of the bottom shell when the liner is mounted in the bottom shell.

According to a second aspect of the present there is provided a gyratory crusher comprising a bottom shell and a wear resistant liner as described herein.

According to a third aspect of the present there is provided a crusher wear resistant liner for positioning at a crusher bottom shell, the liner comprising: a plurality of wear resistant plates mountable at an inside of the bottom shell adjacent to each other to at least partially protect the inside of the bottom shell; each plate comprising side edges and a top and a bottom edge to define a perimeter of the plate; each plate comprising a front face to be orientated towards an interior of the bottom shell and a rear face to be orientated towards an inside surface of bottom shell; characterised in that each plate comprises a lifting eyelet attached to a region of the rear face, the lifting eyelet extending upwardly beyond a top edge of the plate.

Optionally, the liner further comprises at least one interengaging formation configured to engage with an adjacent plate and/or and interengaging formation of an adjacent plate, the interengaging formations configured to at least partially interlock adjacent plates and inhibit or prevent independent dislodgement of each plate from the liner.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
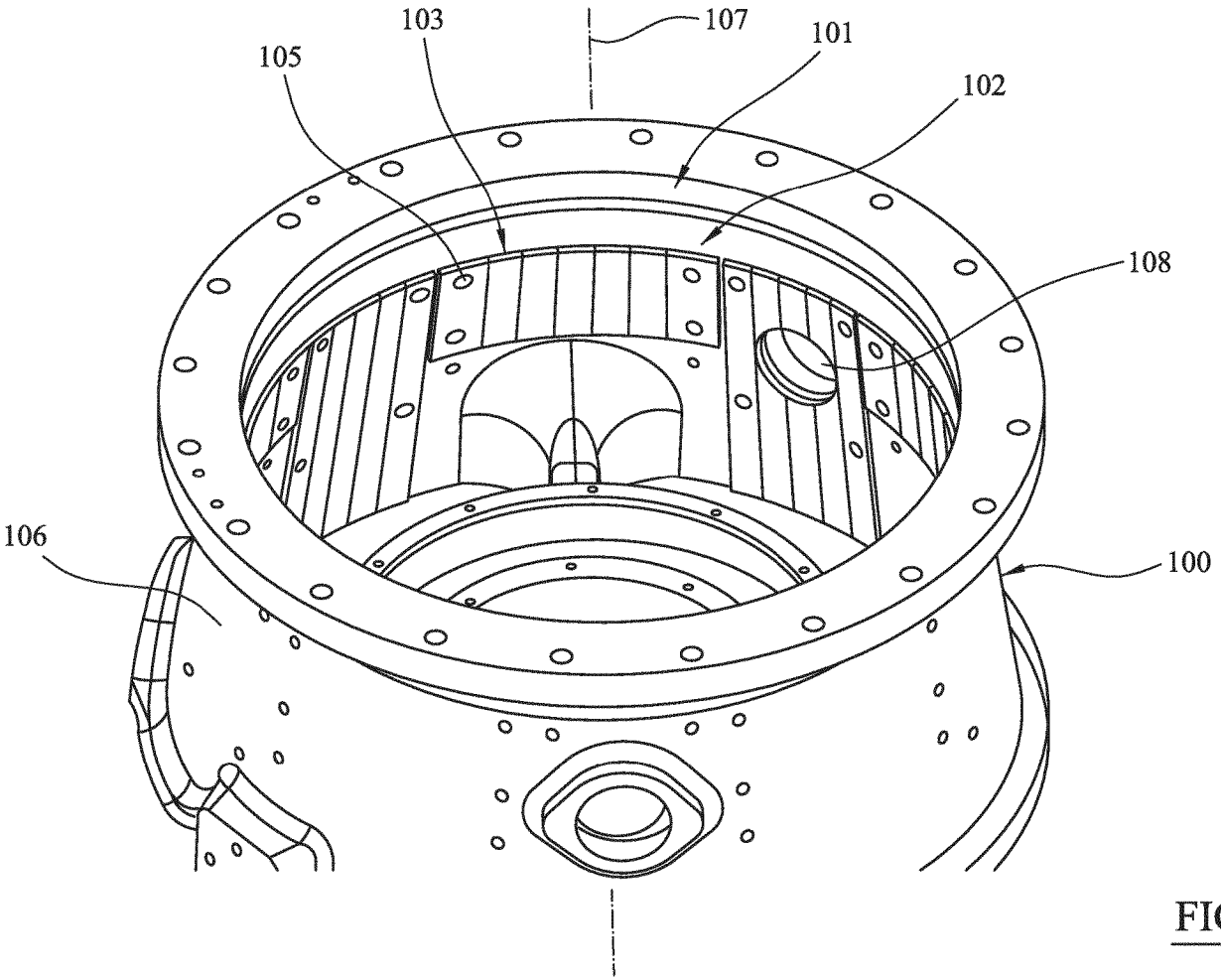
FIG. 1 is an elevated perspective view of a crusher bottom shell comprising a modular wear resistant liner, with each module interlocked in position at an inner surface of the bottom shell according to a specific implementation of the present invention.

A gyratory crusher of the type described above further comprises, according to a specific implementation of the present invention, a bottom shell 100 forming a lower part of a main crusher frame having a top shell part (not shown). The bottom shell 100 comprises walls 106 that circumferentially surround a longitudinal axis 107 extending through the crusher. An inner facing surface 102 of walls 106 defines an internal chamber 101 within bottom shell 100. A modular wear resistant liner 103 is releasably secured to inner surface 102 via a plurality of fixings 105. Fixings 105 comprise bolts that are received within bores that extend through bottom shell walls 106 and are secured by corresponding nuts. In a further implementation, these bores may be threaded to interlock with threaded bolts.

Figure 2:
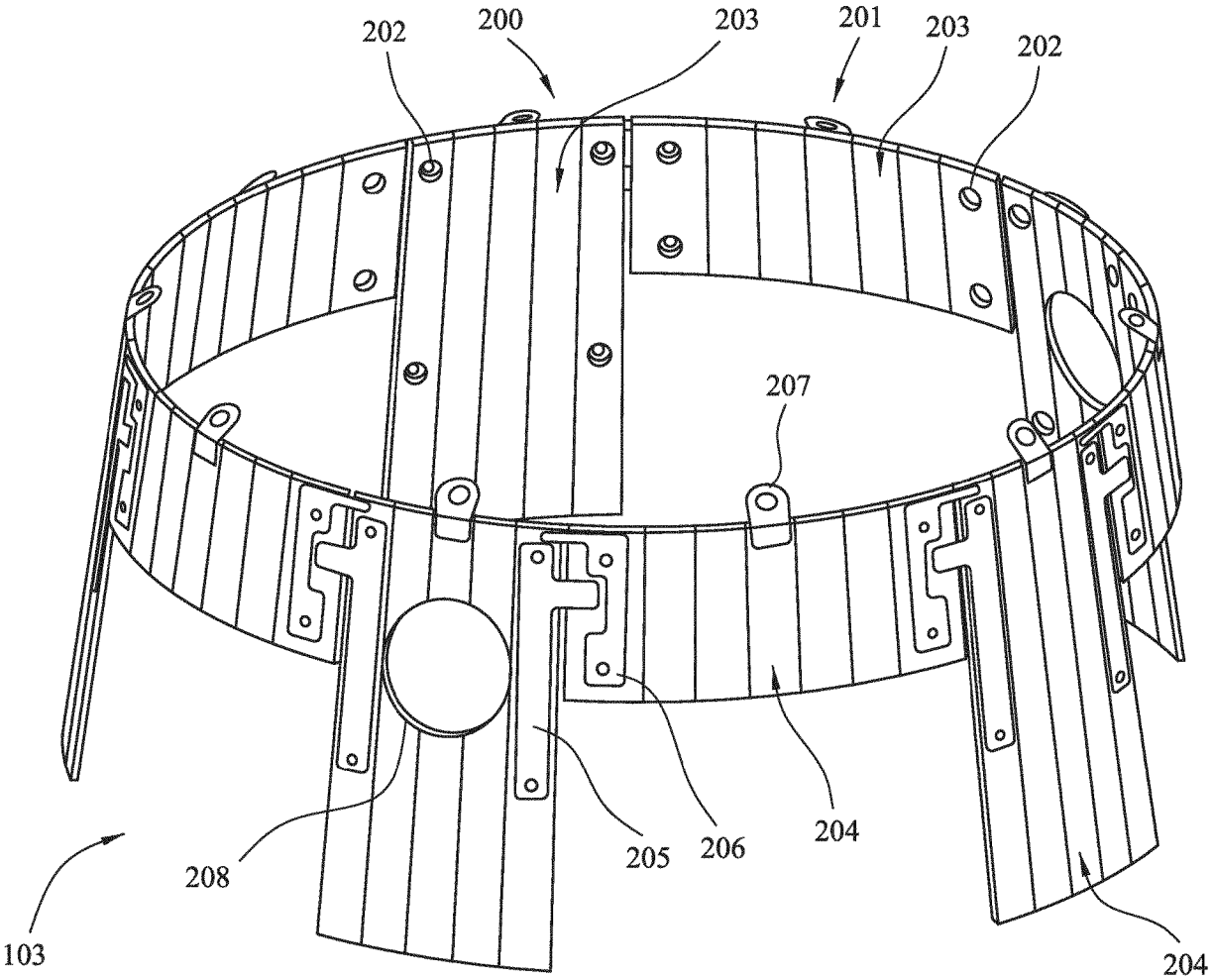
FIG. 2 is an elevated perspective view of the wear resistant liner of FIG. 1.
Figure 3:
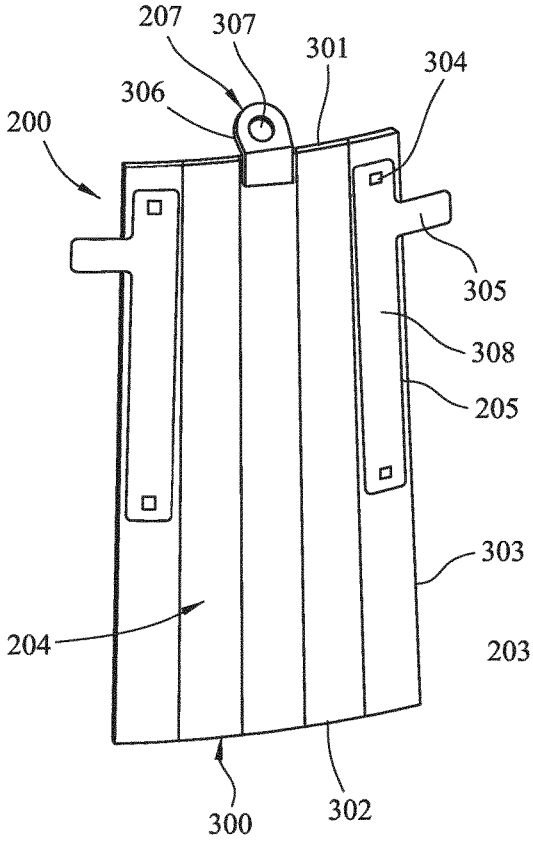
FIG. 3 is a rear perspective view of a first type of plate of the modular liner of FIG. 2.
Figure 4:
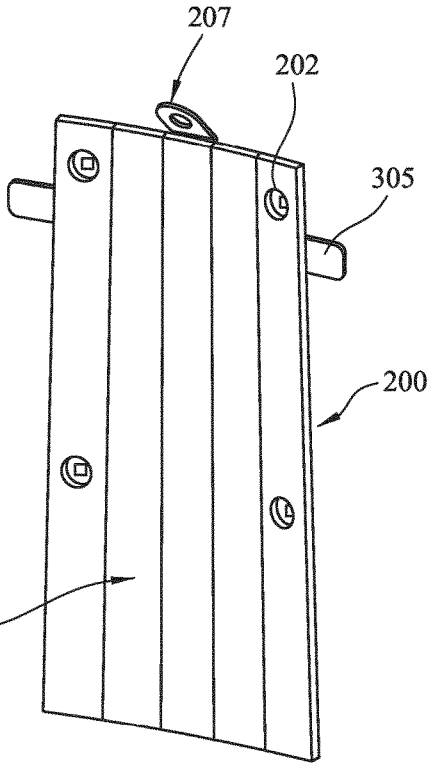
FIG. 4 is a front perspective view of a first type of plate of the modular liner of FIG. 2.
Figure 5:
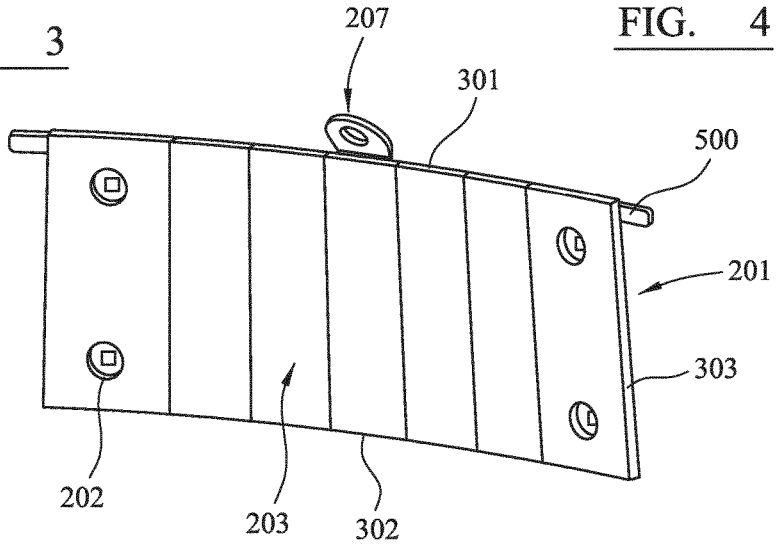
FIG. 5 is a front perspective view of a second type of plate of the modular liner of FIG. 2.
Figure 6:
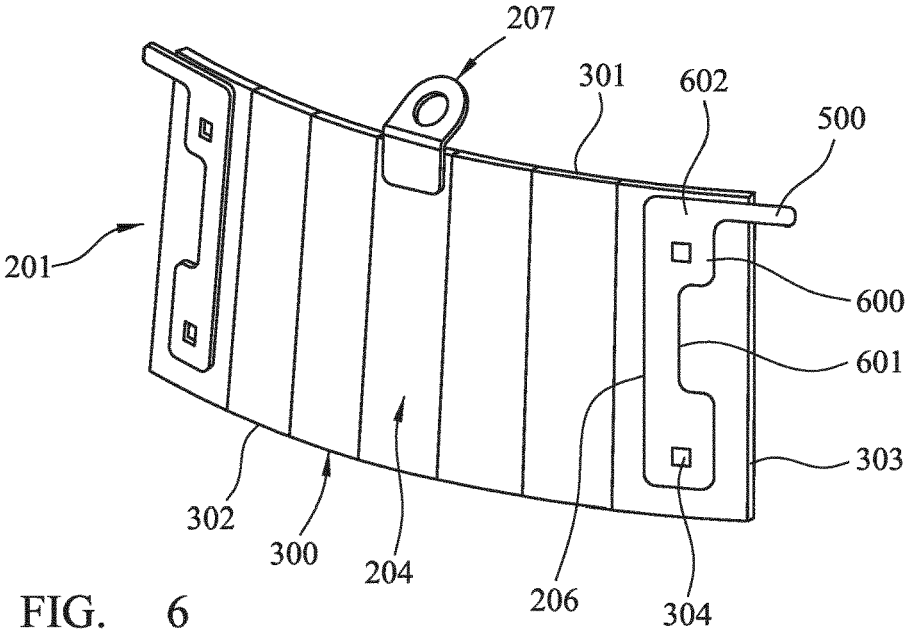
FIG. 6 is a rear perspective view of a second type of plate of the modular liner of FIG. 2.

Referring to FIG. 2, the wear resistant liner 103 comprises a plurality of separate plates 200, 201 positioned side-by-side to extend around the interior surface 102 of bottom shell 100. Each plate 200, 201 comprises a front face 203 intended to be orientated towards the internal chamber 101 and the central longitudinal axis 107 sending through the crusher. Each plate 200, 201 further comprises a rear or mounting face 204 intended to be orientated towards inner surface 102. Each plate 200, 201 comprises a generally panel-like configuration being generally planar. However, to follow the curved profile of inner surface 102, each plate 200, 201 is curved in a widthwise direction between widthwise edges.

Each plate 200, 201 comprises four bore holes 202 to receive fixings 105 for attachment to bottom shell 100. Each hole 202 is positionally spaced from neighbouring holes with each hole 202 being generally positioned towards a perimeter of each plate 200, 201.

Liner 103 comprises a plurality, and in particular five, individual plates of a first type 200 and five individual plates 201 of a second type. At least two first types of plate 200 comprise apertures 208 extending through their main body between front and rear faces 203, 204 for alignment with a corresponding aperture 108 within bottom shell 100.

First plate 200 comprises a first type of interengaging formation 205 and second plate 201 comprises a second type of interengaging formation 206. Formations 205, 206 are both respectively positioned at the rear surface 204 of each plate 200, 201 and are secured in position by a suitable bonding material, such as welding and/or an adhesive. Additionally or alternatively, each formation 205, 206 may be attached to each respective plate 200, 201 via mechanical fixings, such as screws, pins, plugs, rivets etc.

Referring to FIGS. 3 to 6, each of the first and second plates 200, 201 comprises two side edges 303 a top edge 301 and a bottom edge 302 that define a perimeter of each plate. With regard to the first plate 200, a length of side edges 303 is greater than a length of top and bottom edges 301, 302 such that first plate 200 is generally more elongate and has a greater length between top and bottom edges 301, 302. In contrast, the second plate 201 is generally elongate in a widthwise direction in that top and bottom edges 301, 302 comprise a length greater than side edges 303. Each plate 200, 201 is formed from a single piece of material and comprises bend regions that may be considered to define a plurality of elongate segments 300 aligned parallel with each other and side edges 303. The end edges of each elongate segment 300 correspond to the top and bottom edges 301, 302.

Figure 10:
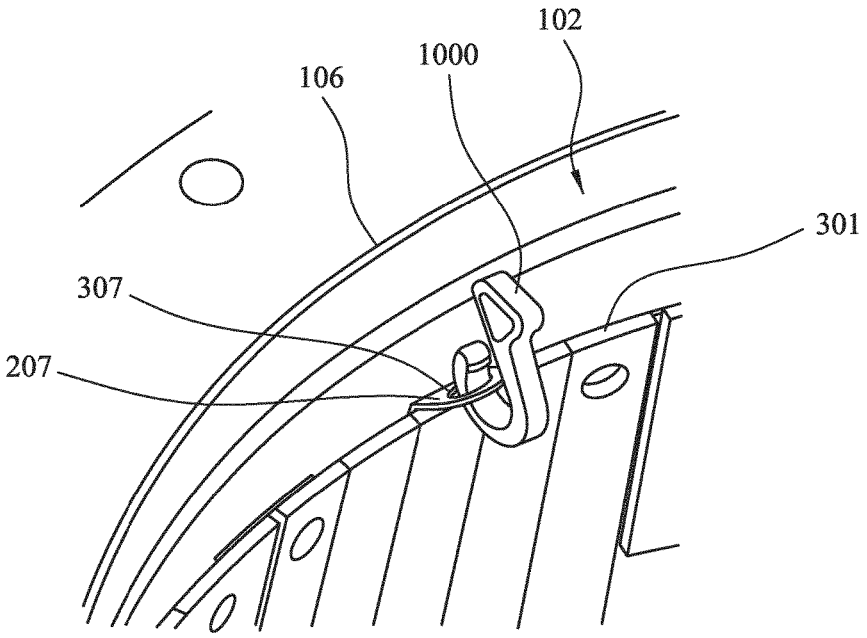
FIG. 10 is an elevated perspective view of a region of the bottom shell and wear resistant liner having lifting eyelets engaging with a lifting hook according to a specific implementation of the present invention.
Figure 11:
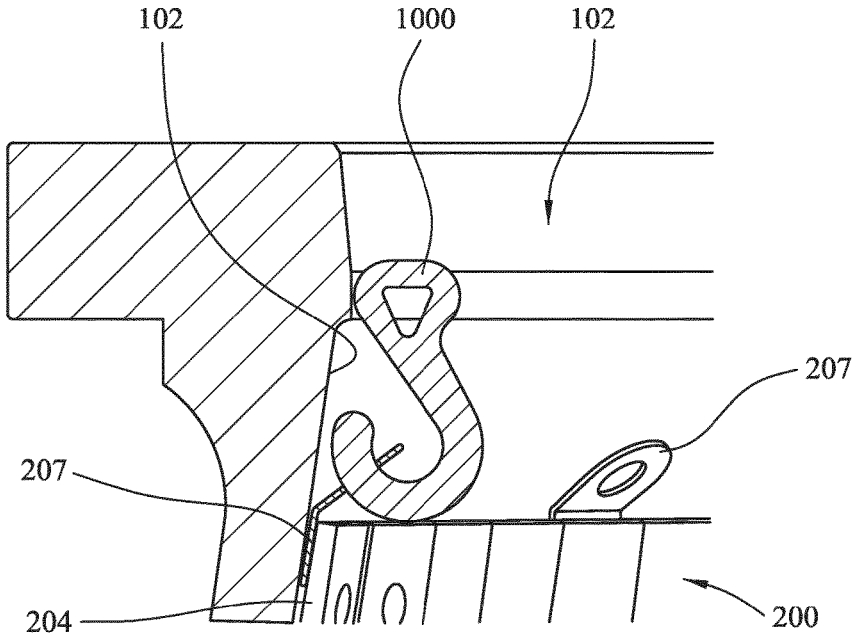
FIG. 11 is a partial section view through the bottom shell and liner arrangement of FIG. 10.

Each plate type 200, 201 includes a lifting eyelet 207 projecting upwardly from top edge 301. Eyelet 207 has a main body 306 having a bent-plate like configuration. The main body 306 includes an eyelet aperture 307 to receive a lifting hook as described with reference to FIGS. 10 and 11. Eyelet body 306 is secured to the rear face 204 of each plate 200, 201 by a bonding material (e.g., welding or an adhesive) and projects forwardly at an inclined angle from rear face 204 beyond front face 203 so as to extend towards longitudinal axis 107 when liner 103 is installed within bottom shell 100.

First plate 200 includes a panel-like attachment 205 positioned in close proximity to each side edge 303. Attachment 205 comprises a strip-like main body 308 that extends longitudinally over a rear face 204 of a single segment 300 (defined by bend regions). A length of main body 308 is approximately equal to half the length of plate 200 with the majority of the fixing 205 positioned at an upper region of plate 200 towards top edge 301. Fixing 205 includes a flange 305 that projects laterally from and perpendicular to side edge 303 by a relatively short distance corresponding to an approximate thickness of each elongate segment 300. That is, a length of flange 305 is approximately equal to 25% of the width of each first plate 200. Additionally, each flange 305 extends from main body 308 at an upper region of fixing 205 and plate 200 and is positioned to extend laterally in the upper region of plate 200.

Each plate 200, 201 comprises a generally a trapezoidal configuration in which the bottom edge 302 comprises a greater length than top edge 301. This configuration ensures complete protection of the inner surface 102 of bottom shell 100 which generally tapers inwardly from a lower region to an upper region towards central axis 107.

Second plate 201 comprises corresponding fixing 206 attached to its rear face 204 in close proximity to side edges 303. Fixing 306 comprises a main body 600 that is generally elongate and extends between top and bottom edges 301, 302. Like first fixing 205, second fixing 206 comprises a length and a width for attachment to a single elongate segment 300 (between the bend regions). The fixing main body 600 comprises a recessed portion 601 indented into its main length between top and bottom edges 301, 302. An upper end region 602 of formation 206 comprises a flange 500 extending perpendicular to main body 600 to project laterally from plate 201 and in particular side edge 303. Flange 500 is positioned immediately below top edge 301. According to the specific implementation, a length of flange 500 is approximately equal to a length of flange 305.

Each interengaging formation 205, 206 comprises bore holes 304 positioned towards the upper and lower end edges of the respective main bodies 308, 600. Each hole 304 is aligned coaxially with holes 202 extending through each plate 200, 201. Accordingly, with this configuration the engaging formations 205, 206 are configured receive the fixings 105 that secure each plate 200, 201 to bottom shell 100.

Figure 7:
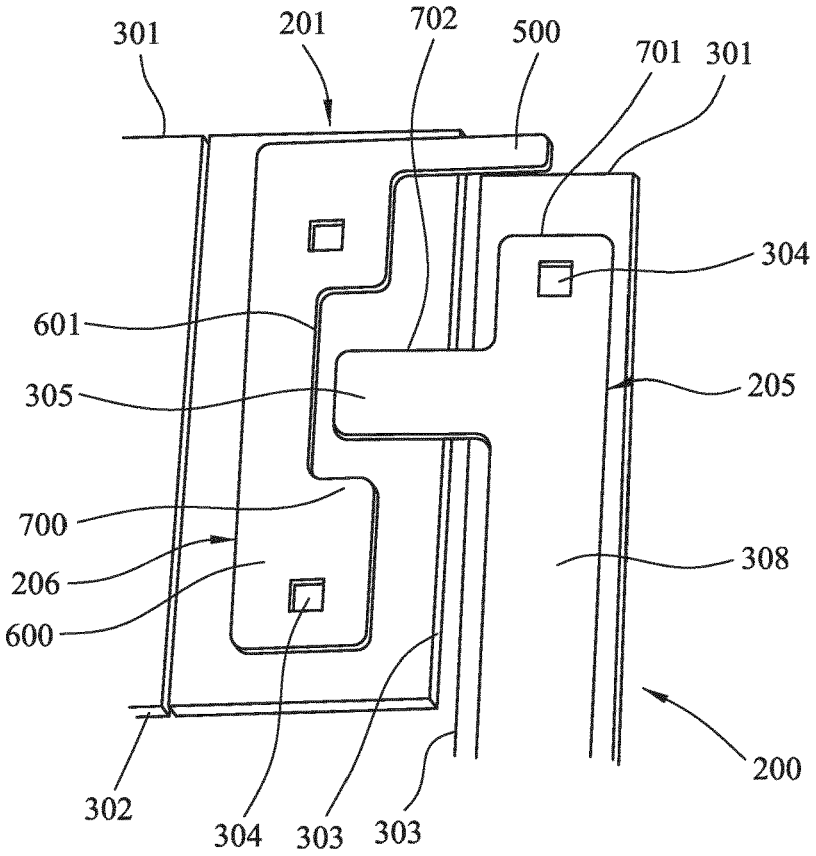
FIG. 7 is a rear perspective view of two interengaging formations coupling adjacent plates of the liner of FIG. 2.
Figure 8:
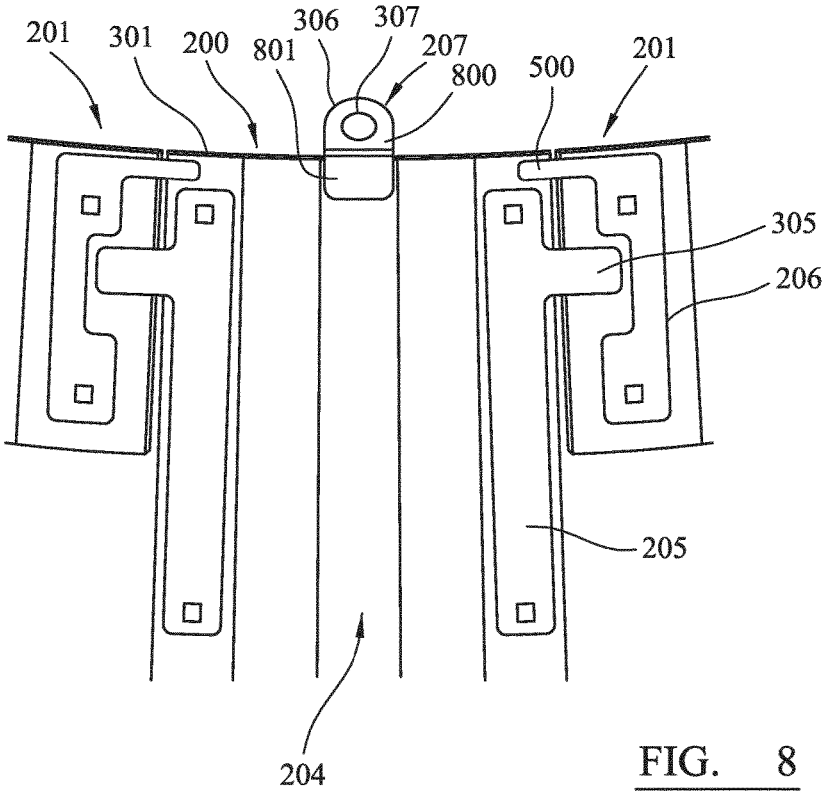
FIG. 8 is a rear perspective view of a first type of plate of the liner of FIG. 2 secured in position between two adjacent second plate types of the liner of FIG. 2.
Figure 9:
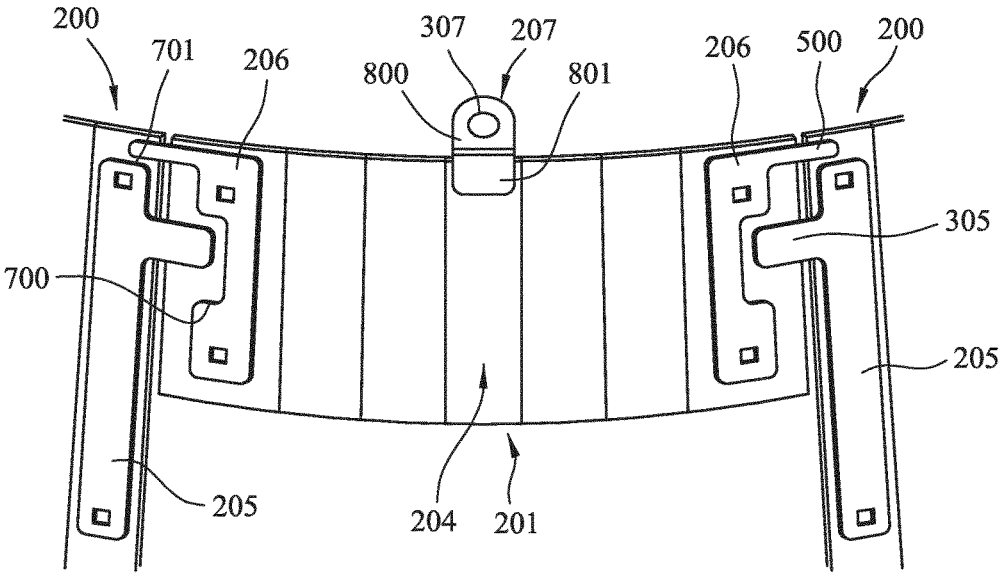
FIG. 9 is a rear perspective view of a second type of plate of the liner of FIG. 2 secured in position between two adjacent first plate types of the liner of FIG. 2.

Referring to FIGS. 7 to 9, the respective pairs of interengaging formations 205, 206 provide a secondary means of ensuring each plate 200, 201 does not fall into the bottom shell chamber 201 should fixings 105 fail or be ineffective to retain each plate 200, 201 at surface 102. FIG. 7 illustrates a partially interlocked configuration in which flange 305 is received within recess 601 such that formations 205, 206 overlap laterally in a direction between top and bottom edges 301, 302. FIGS. 8 and 9 illustrate respectively the first 200 and second 201 plates interconnected to create a unified liner assembly 103. In the event that the primary fixings 105 fail, plates 200, 201 are prevented from falling forward towards axis 107 and away from inner surface 102 by the action of overlapping flanges 305, 500 abutting against the rear surface 204 of the adjacent plate 200, 201. The formations 205, 206 via flanges 305, 500 respectively, may be considered to be the male half of an interlocking assembly whilst the respective rear faces 204 may be considered to be the female half of the interlocking assembly. By positioning the formations 205, 206 at an upper region of each plate 200, 201, the individual liner modules 200, 201 are inhibited and prevented from falling from inner surface 102 and are retained in position as part of the liner assembly 103. In the event that the fixings 105 of any one module 200, 201 do fail and the plate 200, 201 does become dislodged from its primary attachment position as shown in FIGS. 1 and 2, any vertical drop movement is arrested by contact between flange 305, 500 with the adjacent plate 200, 201. That is, and referring to FIG. 8, if fixings 105 fail at plate 200, flange 305 engages onto shoulder 700 (which, in part, defines recess 601) of formation 206 to prevent any further downward movement. Similarly, should fixing 105 of plate 201 fail, flange 500 abuts against either an upper end region 701 of fixing 205 or an upper edge 702 of flange 305.

As indicated, each eyelet 207 comprises a plate-like body bent forwardly at a mid-region. Accordingly, a lower half 801 of eyelet 207 is overlaid and attached to an upper region of rear face 204 of each plate 200, 201 immediately below top edge 301. An upper half 800 projects forwardly from rear face 204 beyond front face 203. In this configuration, eyelet 207 and in particular aperture 307 is capable of receiving an engaging part of a lifting hook 1000. As each plate 200, 201 comprises at least one eyelet body 207, such that each plate 200, 201 may be raised independently from bottom shell 100 for maintenance and/or replacement. According to the configuration of the engaging formations 205, 206, the second plate 201 may require removal at a first stage followed by subsequent removal of first plate 200 in a second stage.

The invention claimed is:

1. A crusher wear resistant liner comprising:

a plurality of wear resistant plates arranged to be mountable adjacent to each other to form the liner, the plurality of wear resistant plates being a plurality of first plates having a first size and a plurality of second plates having a second, different size, each first plate of the plurality of first plates being positionable adjacent each second plate of the plurality of second plates in alternating sequence, each first and second plate of the plurality of wear resistant plates including side edges and a top and a bottom edge to define a perimeter of a respective plate; and at least one inter-engaging formation attached to each of the plurality of wear resistant plates and configured to engage with an adjacent plate and/or an inter-engaging formation of an adjacent plate to at least partially interlock the adjacent plates and inhibit or prevent independent dislodgement of any of the plurality of wear resistant plates, wherein each inter-engaging formation has a panel shaped body mounted to a rear face of each of the plurality of wear resistant plates.

2. The liner as claimed in claim 1, wherein the at least one inter-engaging formation includes a first attachment having a flange that projects laterally from at least one side edge of each respective first plate.

3. The liner as claimed in claim 2, wherein the at least one inter-engaging formation includes a second attachment having a recessed portion to at least partially receive the flange of the first attachment of an adjacent first plate, the recessed portion positioned being adjacent the at least one side edge.

4. The liner as claimed in claim 3, wherein the second attachment of the at least one inter-engaging formation further includes a flange that projects laterally from the at least one side edge of the each respective second plate.

5. The liner as claimed in claim 2, wherein the flange of the first attachment extends from a rear face of the first plate a distance beyond the side edge to overlay onto a rear face of an adjacent second plate so as to provide a laterally extending bridge connecting adjacent plates.

6. The liner as claimed in claim 1, wherein each first plate has a first shape configuration and each second plate has a second shape configuration.

7. The liner as claimed in claim 6, wherein the first plate has a length in a direction between the top and the bottom edge that is greater than a corresponding length of the second plate and the second plate has a width in a direction between the side edges that is greater than a corresponding width of the first plate.

8. The liner as claimed in claim 1, wherein each of the plurality of wear resistant plates includes bore holes arranged to receive fasteners.

9. The liner as claimed in claim 8, wherein each inter-engaging formation includes bore holes positionally spaced apart to align with the bore holes of the plates to receive the fasteners.

10. The liner as claimed in claim 8, wherein each of the plurality of wear resistant plates includes four bore holes and each inter-engaging formation includes two bore holes, each of the plurality of wear resistant plates having two inter-engaging formations positioned adjacent respective side edges.

11. The liner as claimed in claim 1, wherein each of the plurality of plates includes a lifting eyelet.

12. The liner as claimed in claim 11, wherein the lifting eyelet is attached to a respective plate at a rear face of the plate such that a portion of the eyelet is positionable intermediate the.

13. A crusher wear resistant liner comprising:

a plurality of wear resistant plates arranged to be mountable adjacent to each other to form the liner, the plurality of wear resistant plates being a plurality of first plates having a first size and a plurality of second plates having a second, different size, each first plate of the plurality of first plates being positionable adjacent each second plate of the plurality of second plates in alternating sequence, each first and second plate of the plurality of wear resistant plates including side edges and a top and a bottom edge to define a perimeter of a respective plate; and at least one inter-engaging formation attached to each of the plurality of wear resistant plates and configured to engage with an adjacent plate and/or an inter-engaging formation of an adjacent plate to at least partially interlock and inhibit or prevent independent dislodgement of the plurality of wear resistant plates, wherein the at least one inter-engaging formation includes a first attachment having a flange that projects laterally from at least one side edge of each first plate and a second attachment having a recessed portion to at least partially receive the flange of the first attachment of an adjacent first plate, the recessed portion positioned being adjacent the at least one side edge, wherein the first plate includes the first attachment of the inter-engaging formation at each side edge and the second plate includes the second attachment of the inter-engaging formation at each side edge.

14. A gyratory crusher comprising:

a shell; and a wear resistant liner positioned at the shell, the liner including a plurality of wear resistant plates mountable at an inside of the shell adjacent to each other to form a liner and to at least partially protect the inside of the shell, the plurality of wear resistant plates including a plurality of first plates having a first size and a plurality of second plates having a second, different size, each first plate of the plurality of first plates being positionable adjacent each second plate of the plurality of second plates in alternating sequence around the inside of the shell, each first and second plate of the plurality of wear resistant plates including side edges and a top and a bottom edge to define a perimeter of a respective plate, and at least one inter-engaging formation configured to engage with an adjacent plate and/or an inter-engaging formation of an adjacent plate to at least partially interlock and inhibit or prevent dislodgement of the liner or the plurality of wear resistant plates from the shell, wherein each inter-engaging formation has a panel shaped body mounted to a rear face of each of the plurality of wear resistant plates.

* * * * *